US006851556B1

(12) United States Patent
Valdez et al.

(10) Patent No.: US 6,851,556 B1
(45) Date of Patent: Feb. 8, 2005

(54) COLLECTIBLE CARD DISPLAY HOLDER

(76) Inventors: Dominic M. Valdez, 12120 Oregon Ave., Chino, CA (US) 91710; Yolanda Valdez, 12120 Oregone Ave., Chino, CA (US) 91710; Chihsiang Huon, 319 Bennett Pl., Claremont, CA (US) 91711; Mei Li Huon, 319 Bennett Pl., Claremont, CA (US) 91711

( * ) Notice: Subject to any disclaimer, the term of this patent is extended or adjusted under 35 U.S.C. 154(b) by 108 days.

(21) Appl. No.: 10/413,768

(22) Filed: Apr. 15, 2003

(51) Int. Cl.[7] ..... B65D 85/48; G09F 3/18

(52) U.S. Cl. ..... 206/449; 40/661.06; 40/661.07; 40/672; 40/770; 40/771; 40/774

(58) Field of Search ..... 206/449, 454, 206/38–39; 40/655, 661, 663, 668, 770–771, 774, 779–781, 797, 661.06, 661.07

(56) References Cited

U.S. PATENT DOCUMENTS

| | | | | |
|---|---|---|---|---|
| 4,095,361 | A | | 6/1978 | Ledenican |
| 4,145,826 | A | | 3/1979 | Shaw |
| 4,182,061 | A | | 1/1980 | English |
| 4,212,124 | A | | 7/1980 | Gammill |
| 4,531,316 | A | | 7/1985 | Farnum |
| 4,704,770 | A | * | 11/1987 | Minami et al. ..... 24/431 |
| 4,736,538 | A | * | 4/1988 | Pierce et al. ..... 40/779 |
| 4,829,691 | A | | 5/1989 | Manjos et al. |
| 4,878,073 | A | * | 10/1989 | Hoonsbeen ..... 353/120 |
| 4,979,619 | A | | 12/1990 | Hager |
| 5,092,062 | A | | 3/1992 | Palka |
| 5,097,953 | A | | 3/1992 | Gingras |
| 5,224,600 | A | | 7/1993 | Neugebauer |
| 5,249,383 | A | | 10/1993 | McCusker et al. |
| 5,259,136 | A | | 11/1993 | Goserud |
| 5,358,114 | A | | 10/1994 | Neugebauer |
| 5,522,163 | A | | 6/1996 | Neugebauer |
| D375,123 | S | | 10/1996 | Strang |
| 5,651,202 | A | | 7/1997 | Hewitt |
| 5,979,097 | A | | 11/1999 | Moore |
| 6,032,394 | A | | 3/2000 | Hand et al. |
| 2002/0129527 | A1 | | 9/2002 | Vaudreuil |

* cited by examiner

*Primary Examiner*—Bryon Gehman

(57) ABSTRACT

The invention discloses a display holder for securely holding and display a valuable collectible card comprising two panels connected along with a common hinge line or coupled together. The panel has a recessed portion having a suitable card-matchable dimension and a depth for receiving the card to be held, whereas a latchable extending member mounted on the panel is securely matched with a latching mechanism mounted within the cap recess of a holding cap to securely hold the card within the panels.

18 Claims, 13 Drawing Sheets

COLLECTIBLE CARD DISPLAY HOLDER

FIELD OF THE INVENTION

The invention herein described relates generally to collectible card display holder. More particularly, the invention is directed to a secured display holder for valuable collectible cards.

BACKGROUND OF THE INVENTION

The displaying and collecting of favorite cards, such as sports cards or non-sports cards, collectively referred to as "flat card", is known. There are various types of prior art cardholders and display frames for flat cards. One example is U.S. Pat. No. 5,249,383 to McCusker et al., entire contents of which are incorporated herein by reference, discloses a plastic display device for holding and protecting a card or card-like display item comprising a rectangular frame structure with a chamber means of sufficient size for receiving a card or card-like display item. The frame structure further comprises groove means horizontally disposed along the front section below the chamber and a corresponding groove means disposed along the base section whereby the base sections can be detached to provide removal of a card display item from the chamber means. The display device is distinguishable with its groove means for insertion and removal of a card display item.

Further, Gingras in U.S. Pat. No. 5,097,953, entire contents of which are incorporated herein by reference, discloses a card holding device which comprises a lower section and an upper section. The lower section comprises a female surface having a recessed portion having a depth for receiving a card, the depth being approximately equal to the thickness of the card and the upper section comprises a male surface that has a raised central portion which presses against a sport card secured in an inner frame portion of the lower section. The card holding device is distinguishable with its two sectional frame for holding flat cards.

Shaw in U.S. Pat. No. 4,145,826, entire contents of which are incorporated herein by reference, discloses a display holder with a frame having front and rear walls between which a plate is inserted and positioned against the inner side of the front wall, wherein the front wall is apertured to permit viewing of the plate therethrough and means on the rear wall is provided for supporting the plate in a vertical position at three points. The rear wall has a pair of abutment elements adapted to engage the rear side of such article at horizontally spaced apart points along the lower portion of the plate when the plate is so positioned. The Shaw display holder is distinguishable with a supporting arrangement to maintain the plate in a vertical position and ready assembly with adhesives or sealants.

English in U.S. Pat. No. 4,182,061, entire contents of which are incorporated herein by reference, discloses a display frame with at least two different display areas within the frame for exhibiting in one area a two-dimensional object and in another area a three-dimensional object. The display tray defines a concave surface facing the transparent sheet material and forming with the transparent sheet material a space for receiving a three-dimensional object. The English display frame is distinguishable with the special display tray used to cradle the three-dimensional object so that the object can be exhibited through the display frame.

Palka in U.S. Pat. No. 5,092,062, entire contents of which are incorporated herein by reference, discloses a display device for holding and exhibiting placards and the like such as business cards, wherein a plurality of card-receiving pockets are arranged on the front face of a main, plate like body. Each pocket is capable of receiving a plurality of placards in the form of a stack or batch so as to maintain such placards in a neat upright stack with the outer face of the outermost placard of the stack clearly visible to a casual observer. More specifically, the display device has an open-topped pockets arranged with three flanges per pocket. The display device is distinguishable with its open pockets for flat cards.

Gammill in U.S. Pat. No. 4,212,124, entire contents of which are incorporated herein by reference, discloses a frame for wall-mountable displays including a plurality of nails with first heads at the driven end of the nail and second heads axially displaced from the first heads. A resilient structure for supplying directional pressure, such as tension spring wires, is located between the two heads radially extending beyond the first heads when expanded. The Gammill frame is distinguishable with tension spring wires expanded to hold the frame in place by resilient action.

Ledenican in U.S. Pat. No. 4,095,361, entire contents of which are incorporated herein by reference, discloses a display frame for holding a flat member having a separable frame portion separably secured thereto in a manner permitting separation only by an authorized person having a special tool. The separable frame portion is separably secured to the holding frame portion by separable joints, at least one of which includes a locking member completely concealed within the frame and having a movable latch portion yieldably urged to a locked position and being movable to a released position. The display frame is distinguishable with its concealed lacking mechanism preventing from separating the frame unauthorized.

Hewitt in U.S. Pat. No. 5,651,202, entire contents of which are incorporated herein by reference, discloses an expandable display device and sports cardholder arranged in the frame. The cardholder includes two matching transparent panels engaged to hold the card-like object. Indentations in the panels at a periphery edge thereof provide a cutout gripping portion enabling the card holder to be manually grasped by inserting a portion of a finger into the cutout portion. A second embodiment of a transparent cardholder comprises two joined transparent rectangular sides having an access notch in the front and two magnetic strips underneath to attach the holes to the metal backing members. The cardholder is distinguishable with its two dissimilar parts which must have magnetic strips for mounting on the metal backing panels in the metal frame.

Marino in U.S. Patent Application publication 2002/0069567, entire contents of which are incorporated herein by reference, discloses a display frame for displaying encased sports cards and the like with a glass pane, a pre-frame of wood or plastic having a cutout port for each card encased in an inflexible transparent plastic card holder, and an inflexible cardboard backing layer. The card display frame is distinguishable with its capability of holding up to one hundred flat cards within the frame.

Farnum in U.S. Pat. No. 4,531,316, entire contents of which are incorporated herein by reference, discloses an economical frame for photographs, visual displays and three-dimensional objects comprising an envelope with a cropping guide for cropping the display thru a cropped area, when uncropped, protecting the envelope from tearing or damage. The Farnum economical frame is distinguishable with its cropping guide means that, when uncropped, protecting the envelope with a three-dimensional object from tearing or damage.

Manjos et al. in U.S. Pat. No. 4,829,691, entire contents of which are incorporated herein by reference, discloses a display device and protector for suitably holding a card-like object comprising two transparent panels connected along a common hinge line, wherein the first panel has a recess area matching the projection area of the second panel allowing display of the card. The Manjos et al. device is distinguishable with two suitably matching panels for holding the card in between the recess and the projection.

Hager in U.S. Pat. No. 4,979,619, entire contents of which are incorporated herein by reference, discloses a protective case for collectible sport cards comprising front and rear panels of matching elongated rectangular perimeter adapted to be cohesively sealed to enclose a sports card. The Hager case is distinguishable with dimensions of the case relative to the sports card such that the sports card within a sealed case is free to move slightly.

Neugebauer in U.S. Pat. Nos. 5,224,600, 5,358,114, and 5,522,163, entire contents of all three are incorporated herein by reference, discloses a card holder having a transparent base with a lip extending around the periphery of the base thereby forming a pocket for receiving a card. The card holder may comprise a base with a slot therein and a cover with a flange extending from the cover, wherein the flange on the cover engages the slot in the base enabling the threaded fastener engages apertures in both the base and cover to secure the card holder in a closed position. The Neugebauer card holder is distinguishable with a sealed or fastened mechanism for holding the two panels together.

Goserud in U.S. Pat. No. 5,259,136, entire contents of which are incorporated herein by reference, discloses a holder for a collectible card comprising a jacket of two panels with three of the edges bonded together and the remaining edge as an entrance opening to the jacket, and a flexible thin insert member completely fills the jacket except for an aperture defined by four straight interior edges serving to retain a collectible card within the aperture, preventing inadvertent release of the card from the aperture. The Goserud holder is distinguishable with four straight interior edges within the jacket.

Moore in U.S. Pat. No. 5,979,097, entire contents of which are incorporated herein by reference, discloses a display device kit utilizing a card holder in combination with an angled frame to provide a protective, aesthetically pleasing, versatile display of a collectible card. The display device further provides means for viewing at least a portion of the cards through the frame. The Moore display device is distinguishable with a transparent frame for viewing of at least a portion of side of the item through a viewing region in each of the front and rear panels.

Hand et al. in U.S. Pat. No. 6,032,394, entire contents of which are incorporated herein by reference, discloses a placard holder utilizing a mounting plate which confines the placard in a certain position, wherein a plurality of pins are linked to the mounting plate and are capable of passing through the body. A backing member engages the pins through a plurality of apertures. The pins are held in place by a fixation member. The Hand et al. placard holder is distinguishable with a holder for fixing a placard to a body which is durable and versatile.

Further, Vaudreuil in US Patent Application Publication 2002/0129527, entire contents of which are incorporated herein by reference, discloses a card holder for securely linking together an identification card to a validation card so as to prevent fraudulent removal of the identification and validation cards once the latter have been inserted into the card holder. The Vaudreuil card holder is distinguishable with means for displaying the first identification card and the second validation card in an offset relationship relative to each other allowing simultaneous display of both cards.

None of the above inventions and patent, taken either singly or in combination, is seen to describe the instant invention as specified and claimed, particularly the secured display holder that is easily ready for inserting and protecting a valuable collectible card.

While such prior devices provide improvement in the area intended, they all related to some kind of assembly for displaying card-type objects. The main different feature of a secured display holder is its easy insertion at point of exhibition and secured display with protection. In some aspect, it is provided a secured card holder for protecting a valuable card without damage.

SUMMARY OF THE INVENTION

It is one object of the present invention to provide a card display holder for suitably displaying, holding and protecting valuable collectible cards, such as baseball cards.

It is another object of the present invention to provide a card display holder that protects the card from damage, especially from inadvertently opening the holder.

It is still another object of the present invention to provide a card display holder which is simple and inexpensive to make, and convenient for securing a card to be protected between two transparent display panels of the holder.

In some aspect of the present invention, it is provided a display holder for suitably holding a collectible card comprising a panel assembly comprising a transparent front panel and a rear panel coupled together along a common hinge line, wherein the rear panel has a first edge opposing the common hinge line and the front panel has a second edge opposing the common hinge line; the rear panel having a recessed portion having a card-matchabe dimension and a first depth for receiving the card to be held, wherein the first depth is equal to or slightly larger than a thickness of the card; and a holding cap means having a holding cap with a cap recess and a releasibly inserting plug for matchably receiving the first and second edges and holding the first and second edges together inside the cap recess.

In another aspect of the present invention, it is provided a display holder suitable for securely holding a collectible card comprising a panel assembly comprising a transparent front panel and a rear panel coupled together along a common hinge line, wherein the rear panel has a first edge opposing the common hinge line and the front panel has a second edge opposing the common hinge line; the rear panel having a recessed portion having a card-matchable dimension and a first depth for receiving the card to be held, wherein the first depth is equal to or slightly larger than a thickness of the card; and a holding cap means having a holding cap with a cap recess and a latchable plug having matching latching mechanism mounted therein for matchably receiving the first and second edges and latchably holding the first and second edges together inside the cap recess, wherein a latchable extending member connected to either of the first edge or the second edge, the member having a plurality of directional edges and notches allowing latching functions in response to the matching latching mechanism mounted within the plug of the holding cap means.

In still another aspect, it is provided a display holder suitable for holding a collectible card comprising a panel assembly comprising a transparent front panel and a transparent rear panel coupled together along a common edge line, wherein the rear panel has a first edge opposing the common edge line and the front panel has a second edge opposing the common edge line; the rear panel having a recessed portion having a bottom surface, a card-matchabe dimension and a first depth for receiving the card to be held, wherein the bottom surface comprises a slightly concave configuration; and a holding cap means having a holding cap with a cap recess and a plug for matchably receiving the first and second edges and holding the first and second edges together inside the cap recess.

BRIEF DESCRIPTION OF THE DRAWINGS

Additional objects and features of the present invention will become more apparent and the invention itself will be best understood from the following Detailed Description of Exemplary Embodiments, when read with reference to the accompanying drawings.

DETAILED DESCRIPTION OF EXEMPLARY EMBODIMENTS

The preferred embodiments of the present invention described below relate particularly to a display holder with a releasibly inserting holding cap means for allowing exchanging a collectible card at will and/or a latchable holding cap means for allowing holding a collectible card with security. While the description sets forth various embodiment specific details, it will be appreciated that the description is illustrative only and should not be construed in any way as limiting the invention. Furthermore, various applications of the invention, and modifications thereto, which may occur to those who are skilled in the art, are also encompassed by the general concepts described below.

Referring to FIGS. 1 to 13, what is shown is an embodiment of a display holder for suitably holding a collectible card or card-like object comprising a front transparent panel and a rear panel connected along with a common hinge line or coupled together. The rear panel may be opaque, transparent or partially transparent. The rear panel has a first recessed portion having a suitably card-matchable dimension and a depth for receiving the card to be held, the first recessed portion having a flat bottom surface for contacting a first surface of the card. The front panel is flat or has either a second recessed portion or a projecting surface having a suitable card-matchable dimension and a height for engaging a second surface of the card. The height of the projecting surface above a base surface of the front panel is generally less than the depth of the first recessed bottom surface of the rear panel by the approximate thickness of the card.

The holder may be made of thermoplastic or thermosetting material selected from a group consisting of polyvinyl chloride, polyester, polycarbonate, polystyrene, polyether, acrylic, poly(methyl methacrylate), mixture thereof, and the like. The holder may be made of a plastic or a non-plastic material with at least a transparent card viewing section or aperture.

Figure 1:
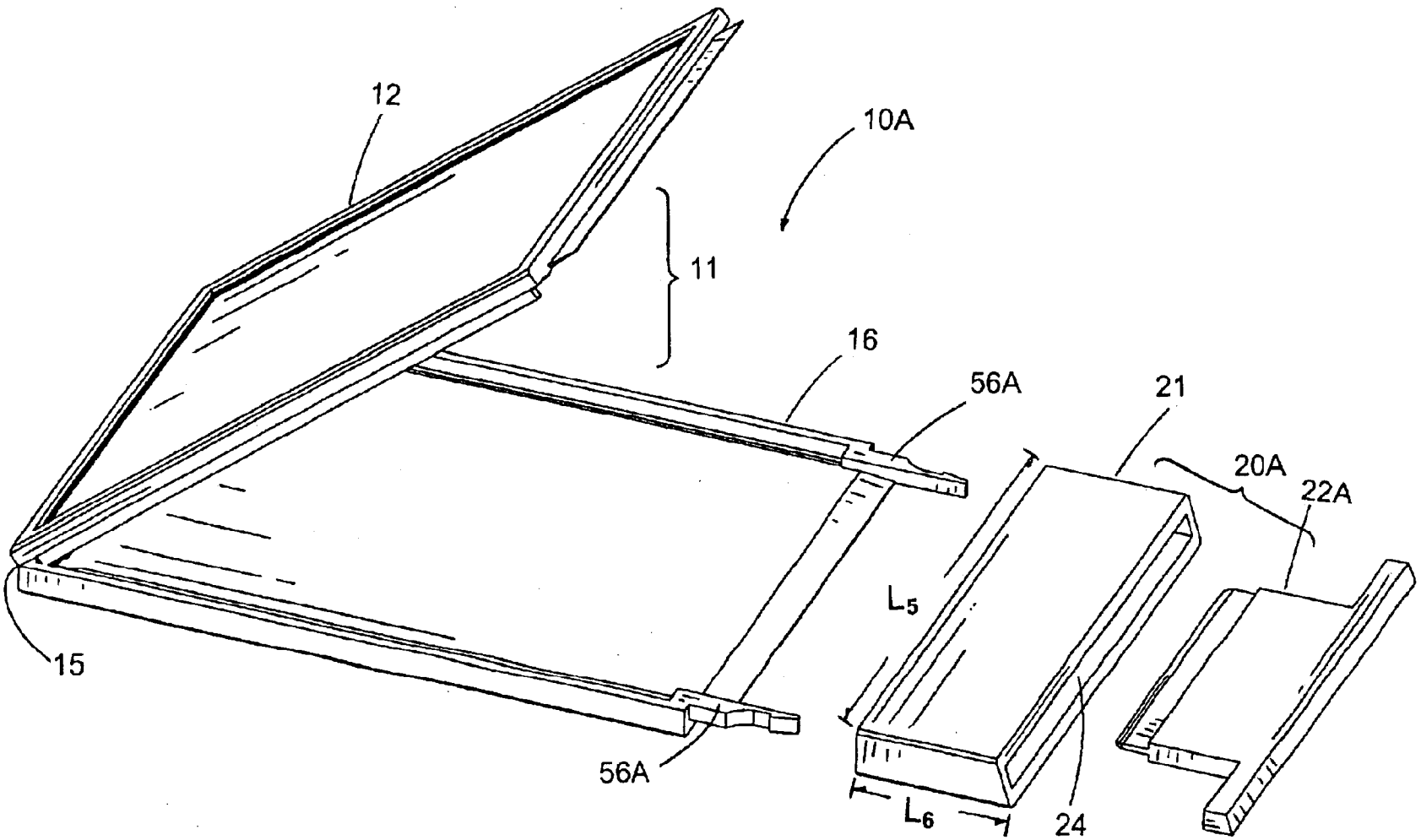
FIG. 1 is a first perspective view of a display holder comprising two panels connected along with a common hinge line and a holding cap with a releasibly inserting plug according to the principles of the present invention.
Figure 2:
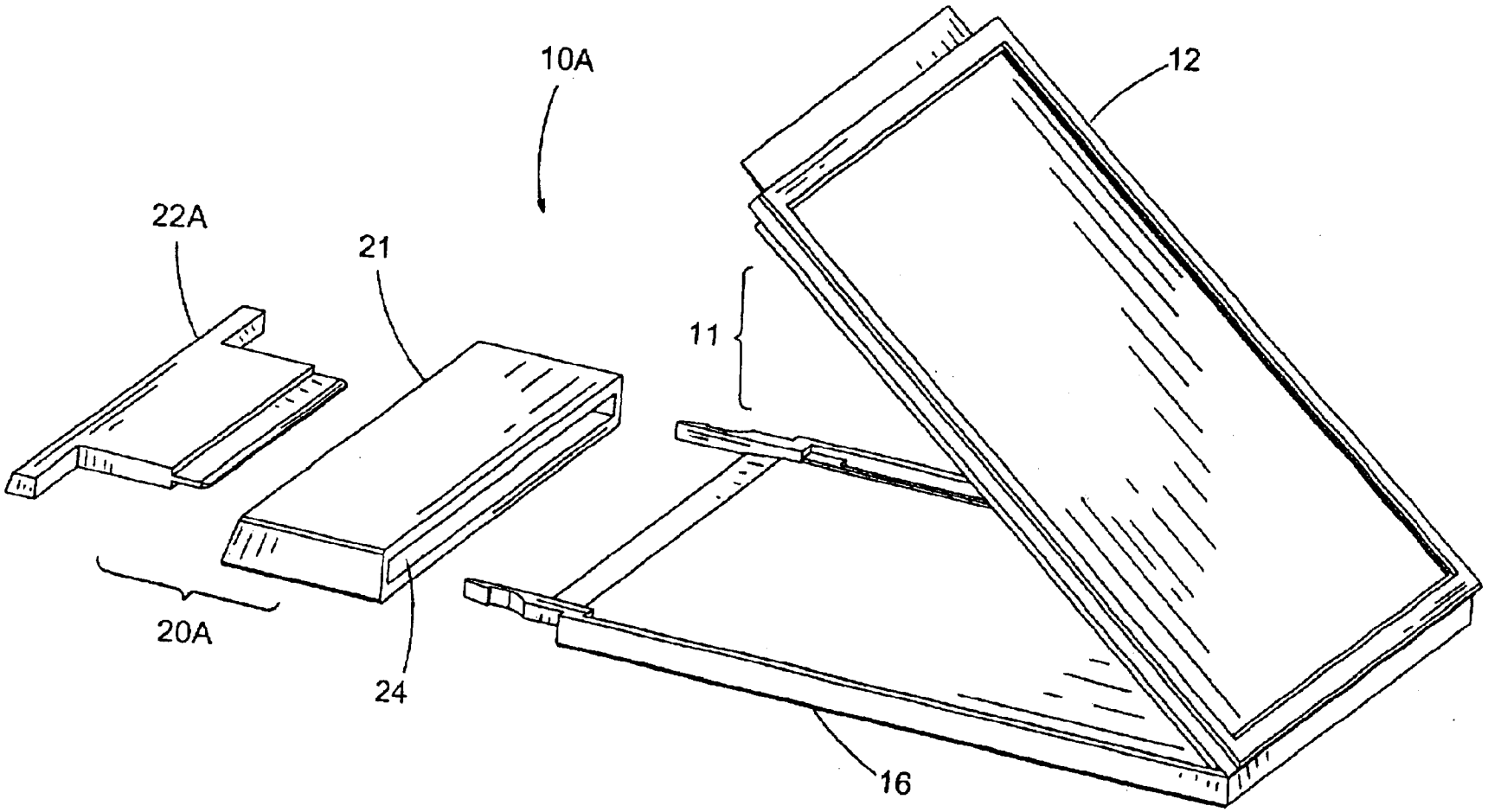
FIG. 2 is a second perspective view of the display holder comprising two panels connected along with a common hinge line and the holding cap with a releasibly inserting plug of FIG. 1.

FIG. 1 shows a perspective view of a display holder 10A comprising two panels (a front panel 12 and a rear panel 16) connected along with a common hinge line 15 (together designated as panel assembly 11) or other suitable coupling means for coupling the two panels 12, 16 together and a holding cap means 20A including a cap 21 with a cap recess 24 and a releasibly inserting plug 22A according to the principles of the present invention. FIG. 2 shows a second perspective view of the display holder 10A comprising two panels connected along with a common hinge line 15 and the cap 21 with the releasibly inserting plug 22A of FIG. 1, showing from another angle. In one embodiment, the releasibly inserting plug 22A is suitably sized and configured to plug the inner space (the receiving recess) 24 of the cap 21 and ensure the card enclosure is waterproof. For example, one suitable coupling means for coupling the two panels 12 and 16 together may comprise a plurality of latches arrangement, including male elements 19A of the latches arrangement on the front panel 12 and matching female elements 19B of the latches arrangement on the rear panel 16 (see FIGS. 3 and 4).

Figure 3:
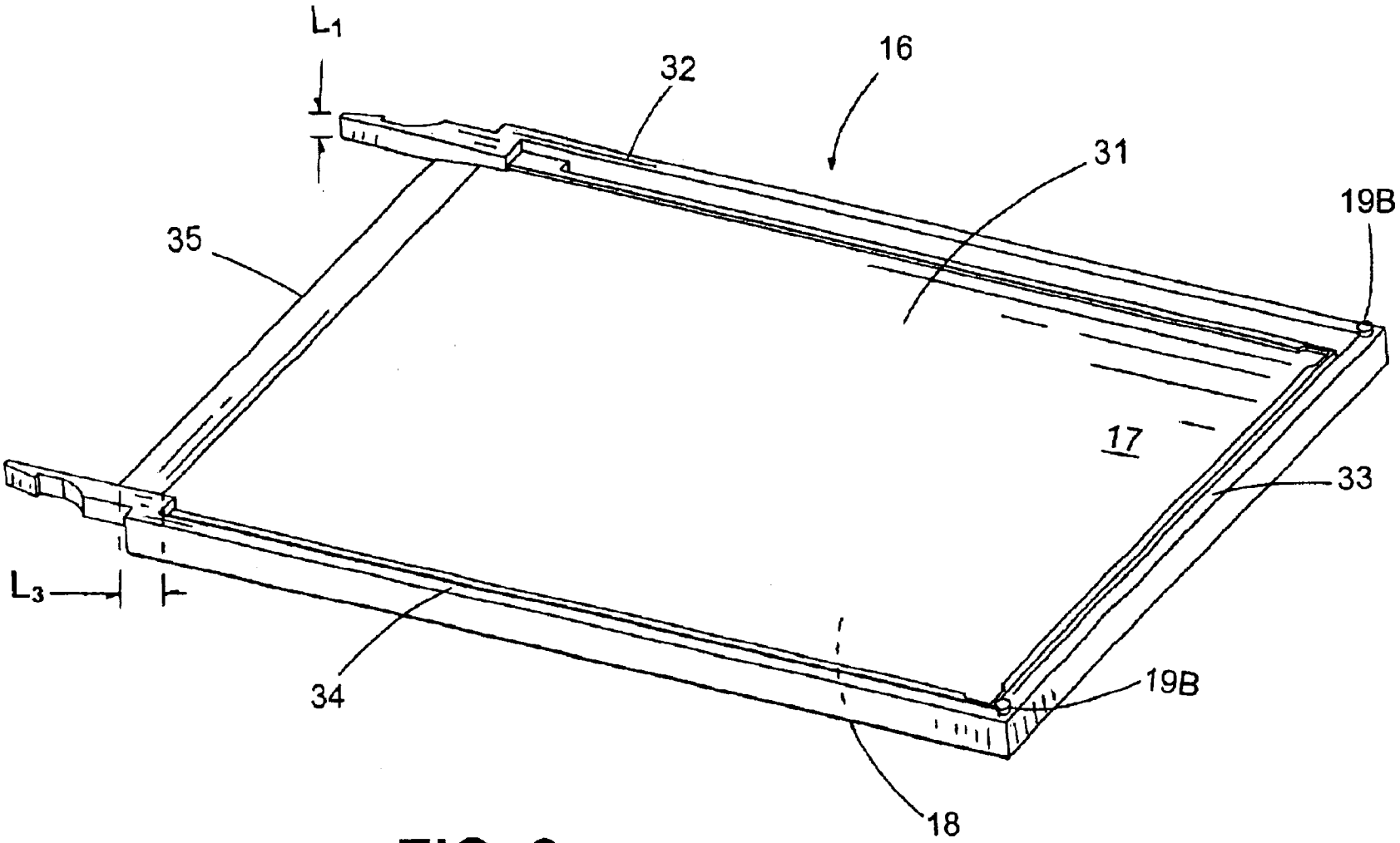
FIG. 3 is a front interior view of the rear panel of the display holder.

FIG. 3 shows a front interior view of the rear panel 16 of the display holder 10A. The rear panel 16 has an interior surface 17 and an opposing exterior surface 18, wherein the rear panel 16 is formed with a recess 31 at about the interior surface 17 into which a card 41 is placed and protected. The exterior surface 18 is generally a smooth flat surface. The recess 31 is suitably sized and dimensioned having a depth, $L_1$, for receiving the card to be held, wherein the recess 31 has a generally flat bottom surface for contacting a first surface of the card. In some aspect of the present invention, the recess 31 of the real panel 16 is bordered by three raised sides 32, 33, 34 while the fourth side 35 has no raised member. The fourth side 35 of the rear panel 16 is intended to be pushed forwardly later into the receiving recess 24 of the holding cap 21. The recess 31 has raised sides suitably for abutting against respective edges of the card, depending on the shape of the card. The "card-matchable dimension" is herein intended to mean that the length and width dimensions of the recess have sides for matching and suitably abutting against respective edges of the card.

In some aspect, recess 31 is essentially co-extensive with the major portion of the area of the rear panel, with the exception of three edge raised portions 32, 33, 34. The distance $L_3$ of the extending portion of the fourth side 35 beyond the corresponding raised members 32 and 34 is sized appropriately to be received by the recess 24 of the holding cap 21. For displaying a non-rectangular card, the recess 31 is sized and configured conformable to the size and shape of the non-rectangular card.

Figure 4:
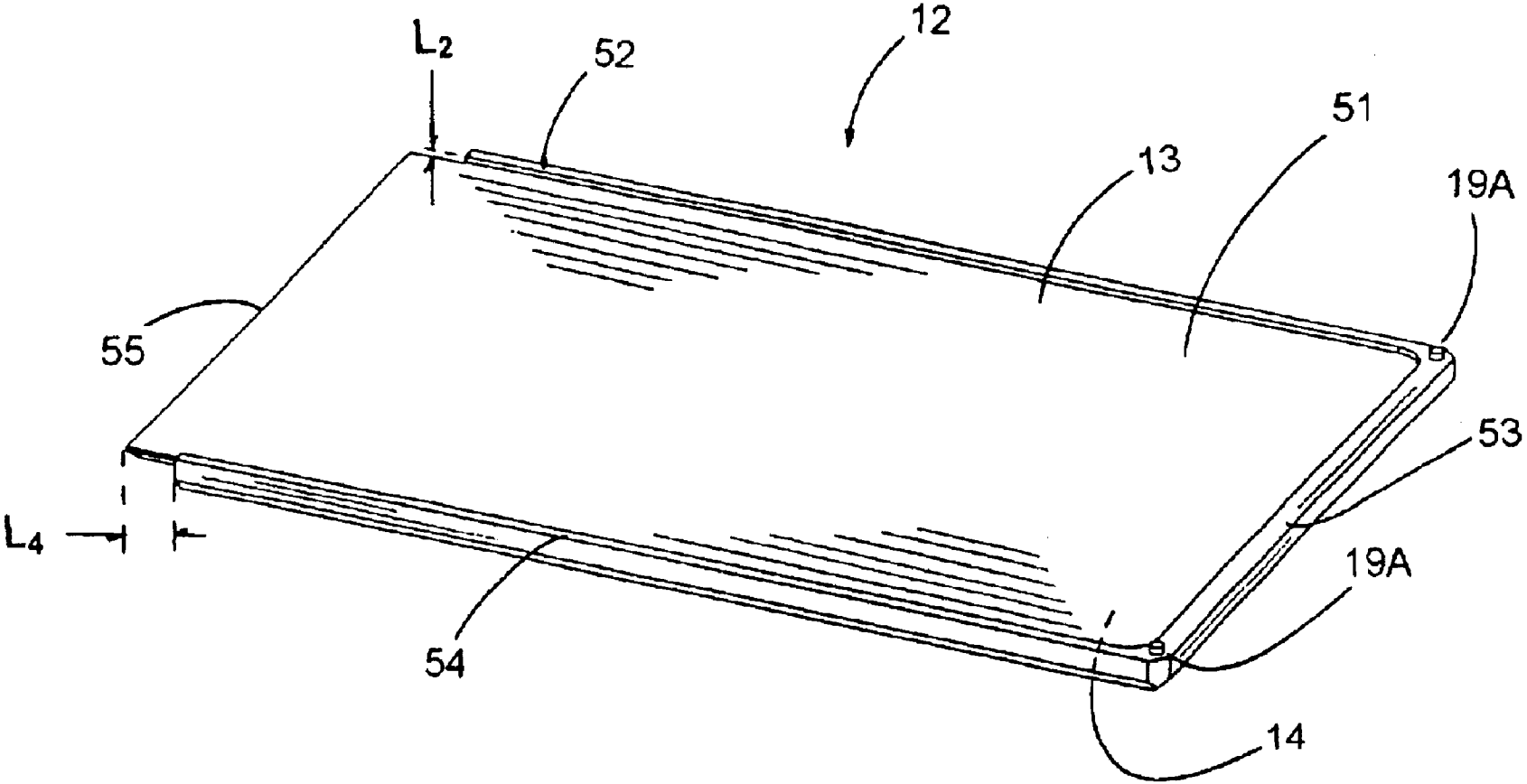
FIG. 4 is a front interior view of the front panel of the display holder.

FIG. 4 shows a front interior view of the front panel 12 of the panel assembly 11 of the display holder 10A. The front panel 12 has an interior surface 13 and an opposing exterior surface 14. The exterior surface 14 is generally a smooth flat surface. In one aspect as shown, the front panel 12 is formed with a recess 51 at about the interior surface 13 into which a card 41 is placed and displayed. In some aspect, the recess 51 is suitably sized and dimensioned having a depth, $L_2$, for receiving the card to be held, wherein the recess 51 has a flat bottom surface for contacting a second surface of the card 41. In one aspect, the sum of $L_1$ and $L_2$ is about equal to or a little more than the thickness of the displaying card. In another aspect, the front panel 12 is formed with a projecting surface (not shown) having a height for engaging a second surface of the card, the height of the projecting surface above a base surface of the front panel 12 being less than the depth $L_1$ of the recessed bottom surface 31 of the rear panel 16 by the approximate thickness of the card.

In some aspect of the present invention, the recess 51 of the front panel 12 is bordered by three raised sides 52, 53, 54 while the fourth side 55 has no raised member, the fourth side 55 of the front panel 12 is intended to be pushed forwardly later along with the rear panel 16 into the recess 24 of the holding cap 21. In one aspect, the recess 51 is essentially co-extensive with the major portion of the area of the front panel 12, with the exception of three edge portions 52, 53, 54. The distance $L_4$ of the extending portion of the fourth side 55 beyond the raised members 52 and 54 is sized appropriately to be received by the recess 24 of the holding cap 21. For displaying a non-rectangular card, the recess 51 or the projection surface portion of the front panel 12 is sized and configured conformable to the size and shape of the non-rectangular card.

In one embodiment, an integral hinge 15 is molded into the plastic panel assembly 11 and connects the front panel 12 to the rear panel 16.

Figure 5:
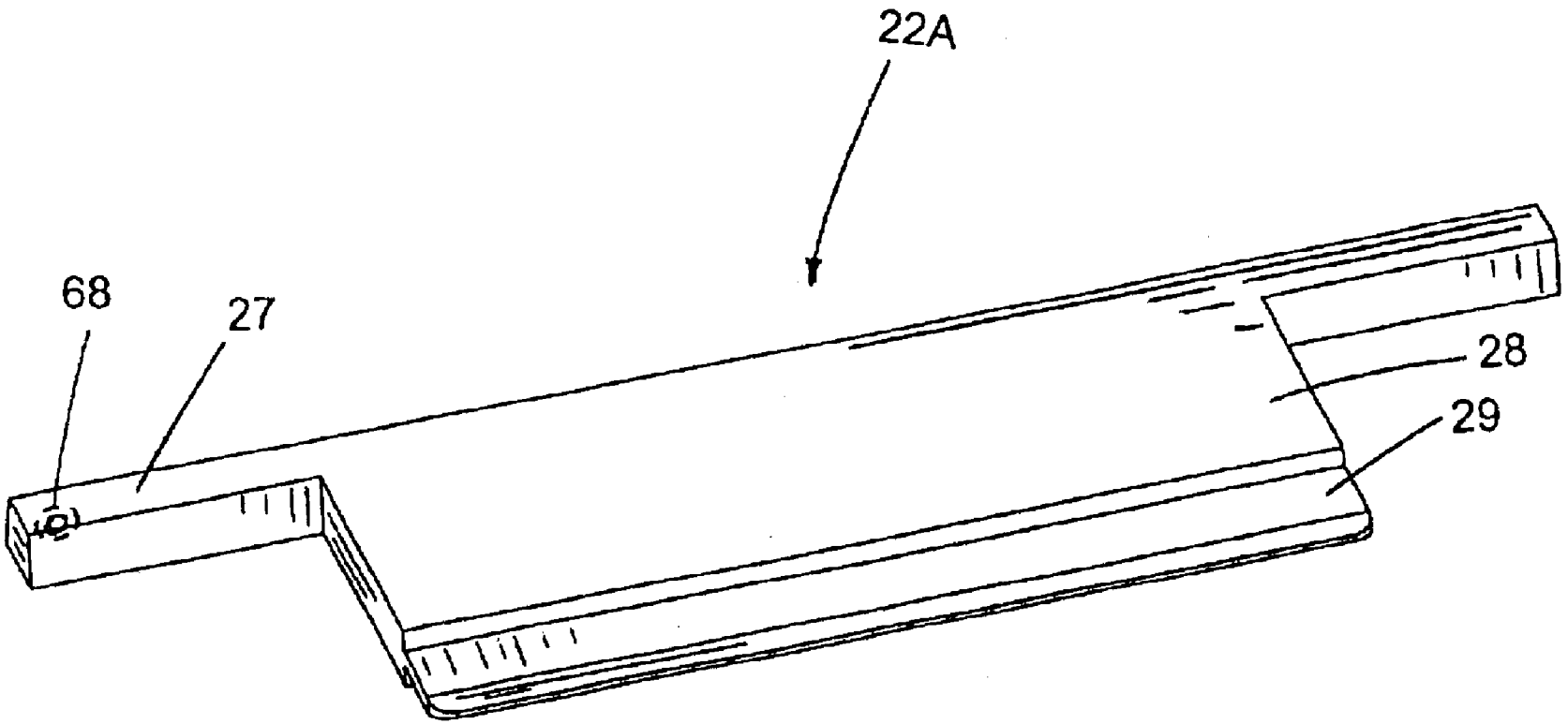
FIG. 5 is a front view of the releasibly inserting plug of FIG. 1.
Figure 6:
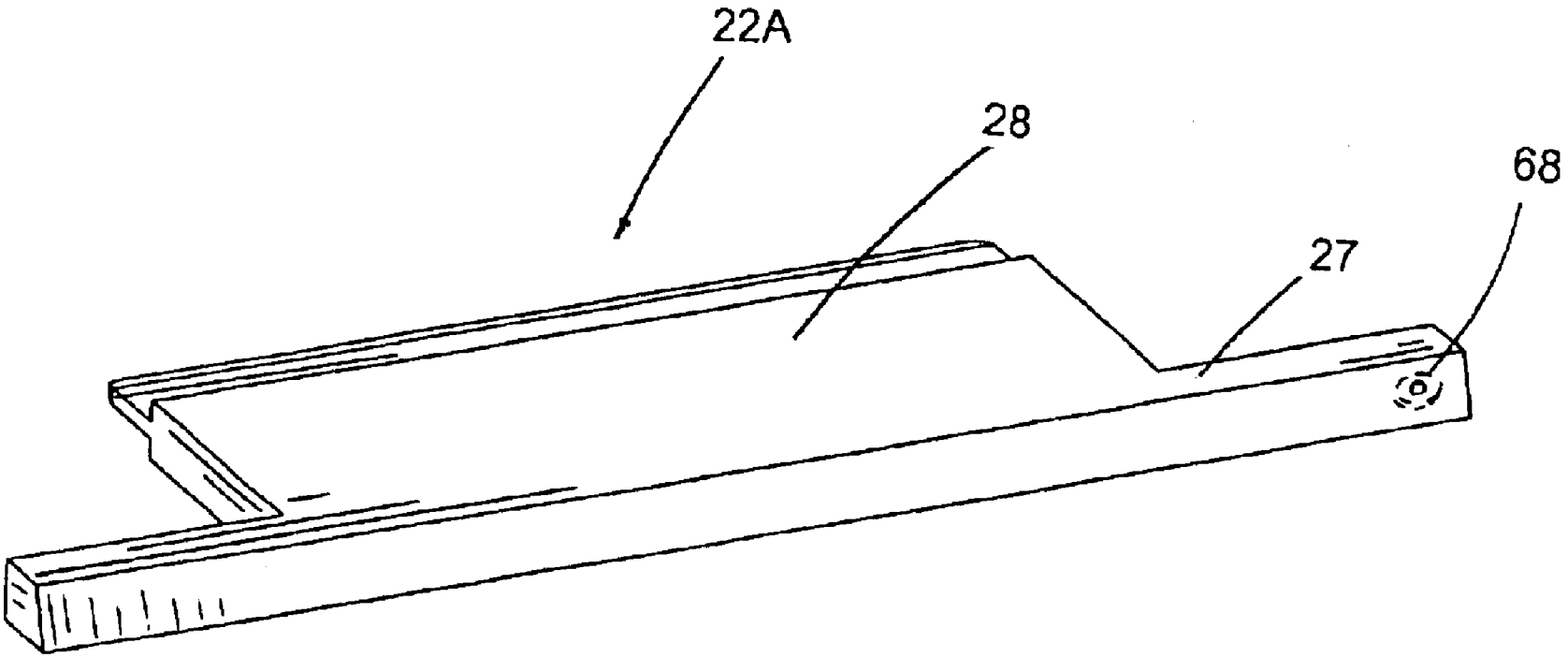
FIG. 6 is a rear view of the releasibly inserting plug of FIG. 1.

In a preferred embodiment, the panel assembly 11 with a collectible card is inserted into the recess 24 of the holding cap 21 of the holding cap means 20A with a releasibly inserting plug 22A. For illustration purposes, FIG. 5 shows a first front view of the releasibly inserting plug 22A, while FIG. 6 shows a second rear view of the releasibly inserting plug 22A of FIG. 1. The plug 22A comprises a plug base 27 having a length about the same width dimension $L_5$ of the cap 21. The plug further comprises a protrusion 28 suitably matching the inner space 24 and the length dimension $L_6$ of the cap 21. The distal end of the plug is generally equipped with a guiding member 29 enabling the plug 22A to be smoothly inserted into the cap 21 and thereafter to assist holding the fourth sides 35 and 55 of the front and rear panels together after the insertion step.

In one embodiment, the holding cap 21 or the plug 22A of the holding cap means 20A is color coded for card-type or holder type identification. Some of the valuable collectible cards worth tens of thousands dollars while other collectible cards may worth a few hundred dollars. It is advisable to color code the cap 21 or the plug 22A for easy visual identification and inventory. In another embodiment, the releasibly inserting plug 22A or the holding cap 21 of the holding cap means 20A has an embedded microchip 68 with pre-loaded data for card identification, inventory and tracing with an electronic recognition system.

Figure 7:
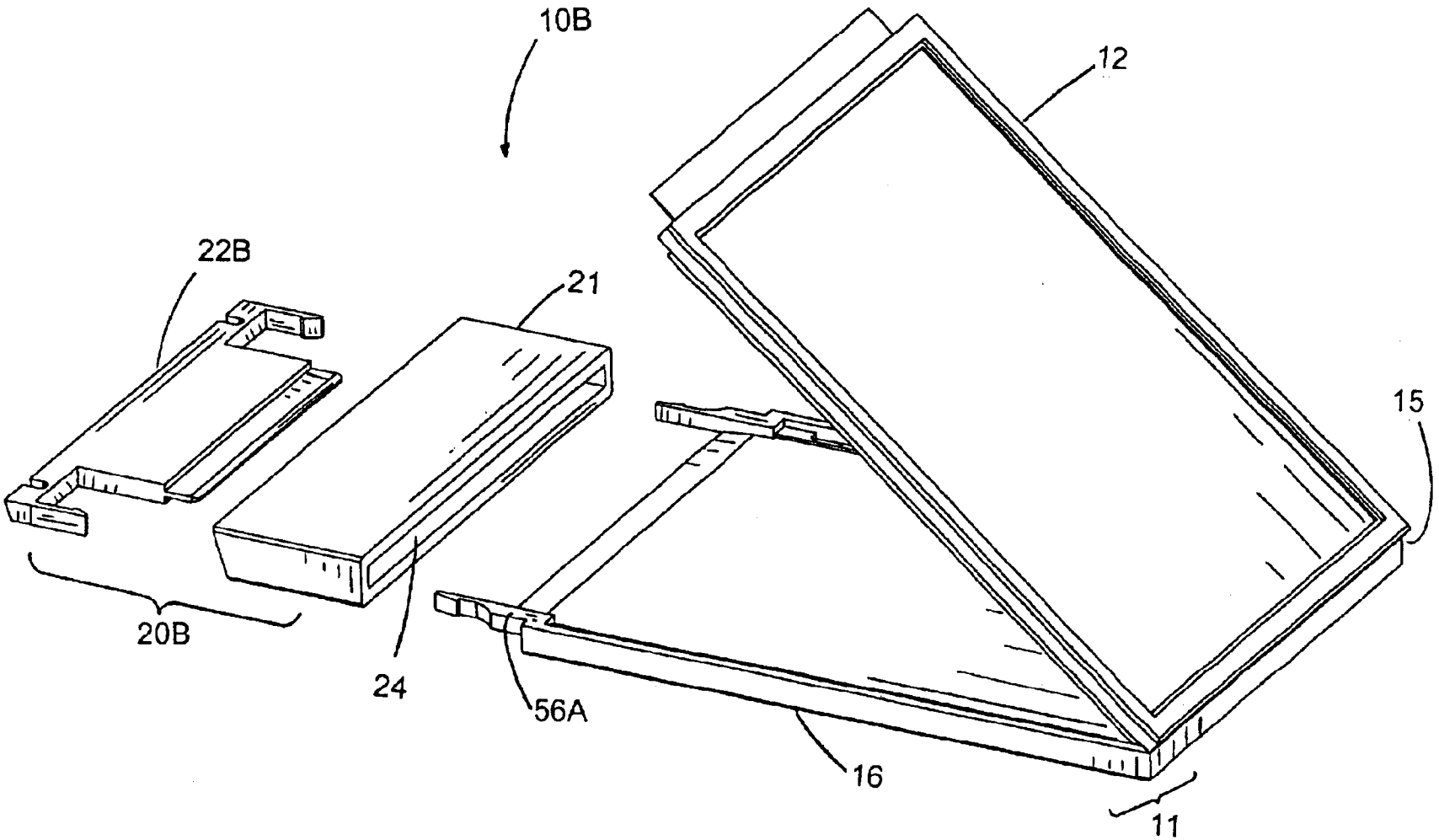
FIG. 7 is a first perspective view of a display holder comprising two panels connected along with a common hinge line and a holding cap with a securely latchable plug according to the principles of the present invention.
Figure 8:
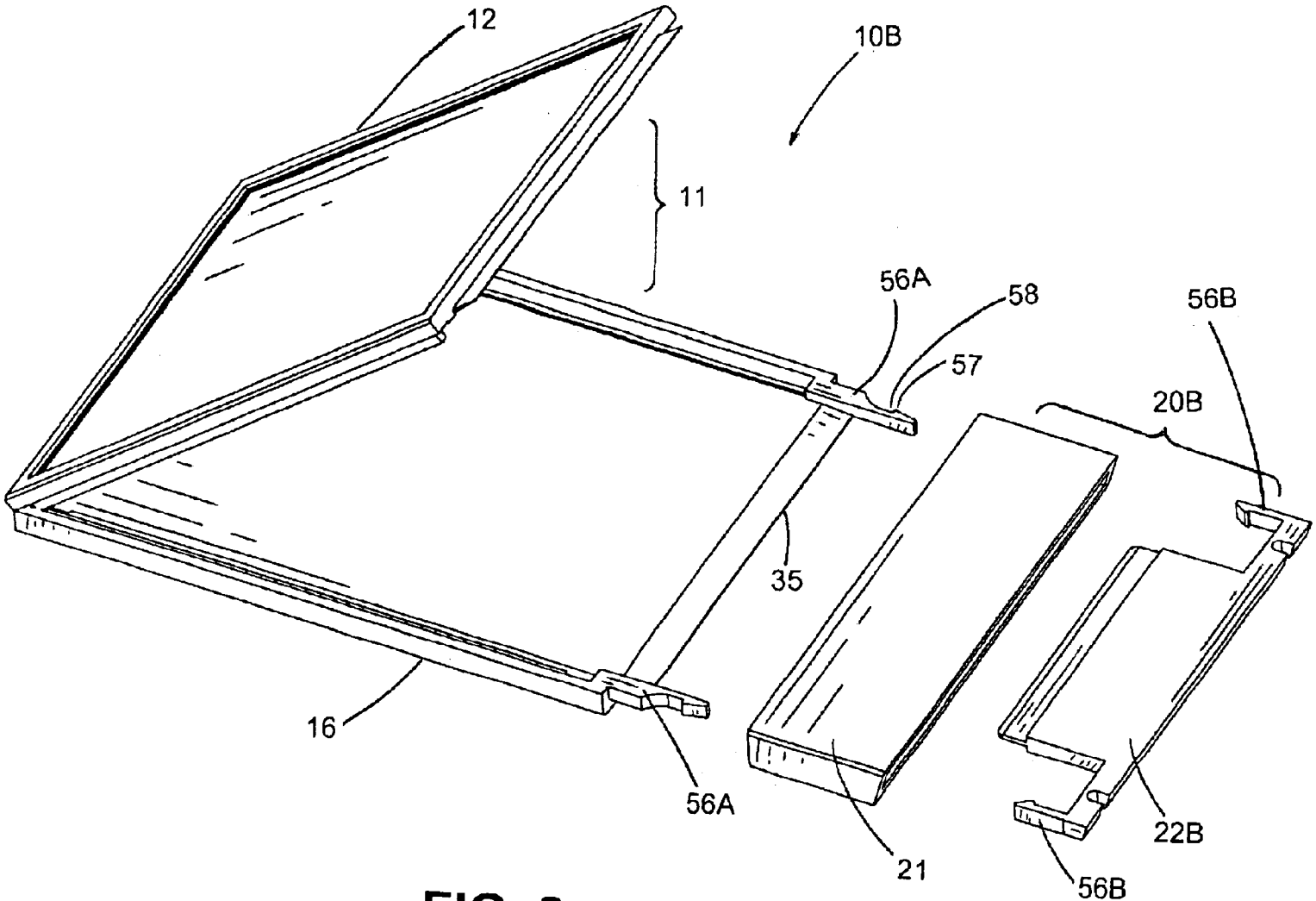
FIG. 8 is a second perspective view of the display holder comprising two panels connected along with a common hinge line and the holding cap with a securely latchable plug of FIG. 7.

FIG. 7 shows a first perspective view of a display holder 10B comprising a panel assembly 11 including two panels 12, 16 connected along with a common hinge line 15 and a holding cap means 20B having a cap 21 with a cap recess 24 and a securely latchable plug 22B according to the principles of the present invention, while FIG. 8 shows a second perspective view of the display holder comprising the panel assembly 11 having two panels 12, 16 connected along with a common hinge line and the holding cap with a latchable plug 22B of FIG. 7. The panel assembly 11 and the holding cap 21 have been described in details (FIGS. 1–4) in the specification.

The panel assembly 11 further comprises at least one latchable extending member 56A adjacent to the fourth side 35 of the rear panel 16. In one aspect, the member 56A is a male latchable extending member that has a plurality of directional edges 57 allowing latching functions in response to a matching latching mechanism 56B on the latchable plug 22B. The latchable extending member 56A also comprises a plurality of notches 58 behind the directional edges 57 suitably for securely latching the matching elements from the matching latching mechanism 56B, which is located on the appropriate location of the latchable plug 22B.

The holding cap 21 and the plug 22A, 22B are sized and dimensioned to accommodate the overall dimension of the panel assembly 11 to become an eye-pleasing display holder after the card placement. The cap 21 comprises an interior space 24 for receiving the panel assembly 11 and the plug 22A or 22B enabling a card holder with functions of holding a releasibly inserted card or a securely latched card that is not releasibly exchangeable.

Figure 9:
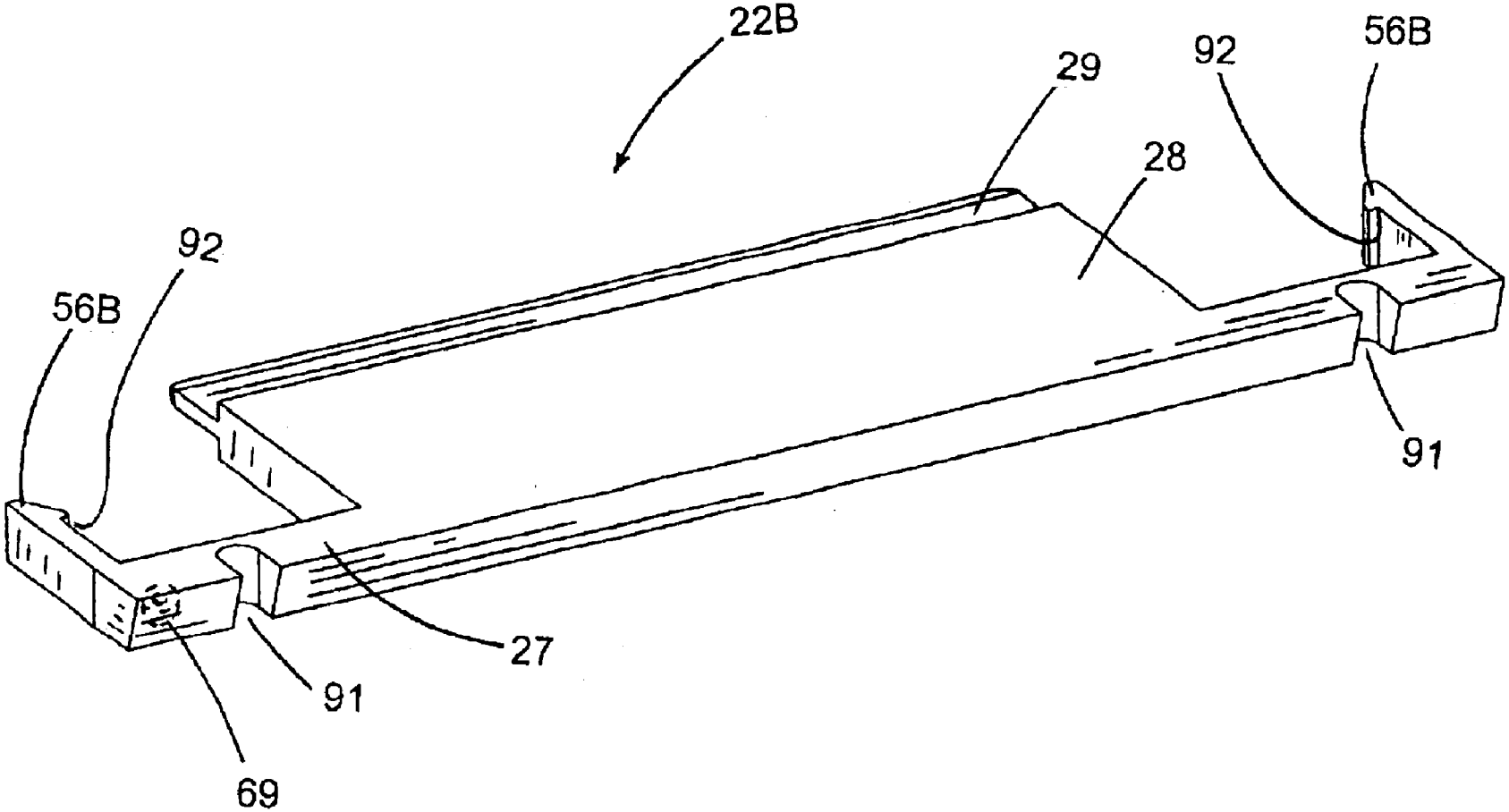
FIG. 9 is a front view of the latchable plug of FIG. 7.
Figure 10:
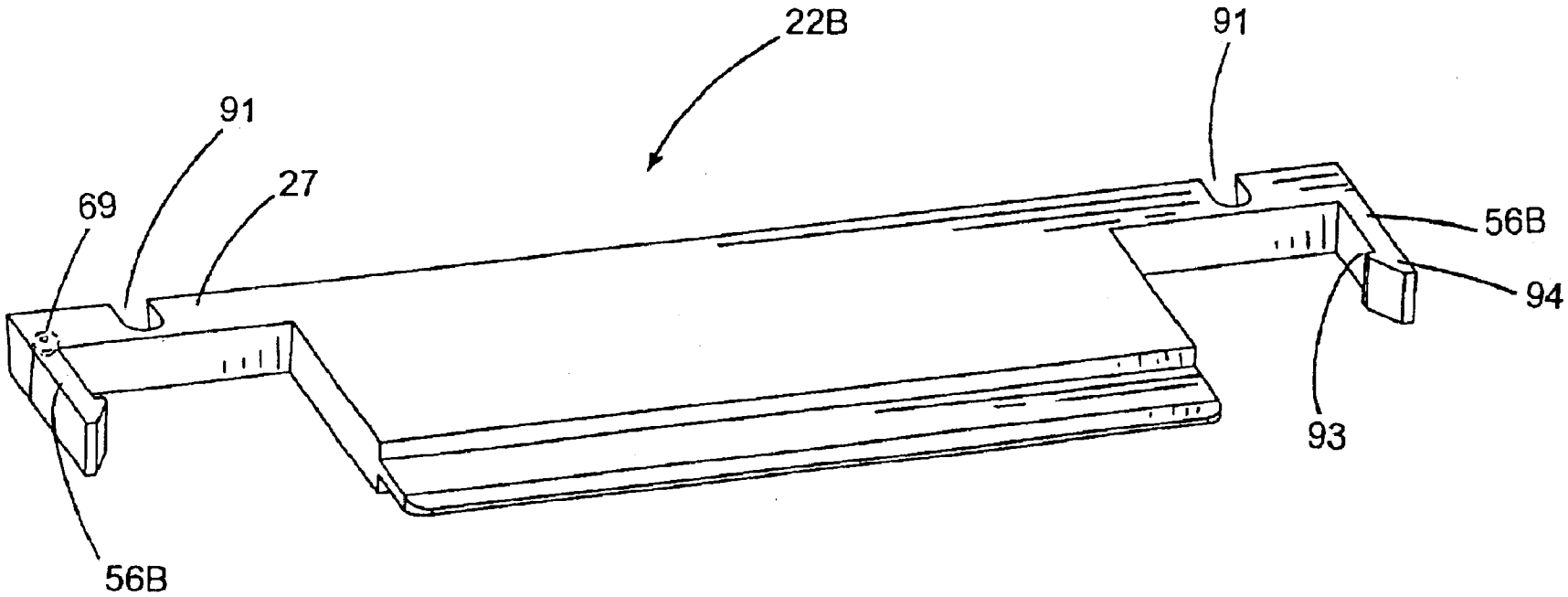
FIG. 10 is a rear view of the latchable plug of FIG. 7.

The matching latching mechanism 56B located on the latchable plug 22B adjacent to the plug base 27 is shown in FIGS. 9 and 10. For illustration purposes, FIG. 9 shows a first, front view of the latchable plug 22B, while FIG. 10 shows a second, rear view of the latchable plug 22B of FIG. 7. The plug 22B comprises a plug base 27 having a length about the same width dimension $L_5$ of the cap 21. The plug 22B also comprises a protrusion 28 suitably matching the inner space 24 and the length dimension $L_6$ of the cap 21. The distal end of the plug is generally equipped with a guiding member 29 enabling the plug 22B to be smoothly inserted into the cap 21 and thereafter holding the fourth sides 35 and 55 of the front and rear panels together after the insertion step. In one embodiment, the plug 22B further comprises at least one matching latching member 56B made of tension spring material with a small opening 92 intended for receiving the directional edge 57 of the latchable extending member 56A.

The tension spring 94 constitutes a resilient structure for supplying directional pressure facing the opening 92. When the latchable extending member 56A of the panel assembly 11 is pushed into the opening 92, the tension spring 94 is first pushed outwardly. After the directional edge 57 passes over the end 93 of the tension spring 94, the end 26 springs back and resides in the notch 58 of the latchable extending member 56A. In some aspect, the securely latchable plug 22B or the holding cap 21 of the holding cap means 20B is color coded or identifiable with, for example, at least one marker or indent 91. Further, the latchable plug 22B or the holding cap 21 of the holding cap means 20B has an embedded microchip 69 with pre-loaded data for card identification, inventory and tracing with an electronic recognition system.

In operations for a non-latchable card placement, a collectible card 41 is placed into the recess 31 of the rear panel 16 when the two panels 12, 16 of the panel assembly 11 are separated at an angle ready for receiving a card. In one embodiment, at least one panel is transparent or partially transparent. The front panel 12 is then lowered toward the rear panel 16 so as to enclose the card 41 inside the recess area as desired. The interior side 24 of holding cap 21 then moves forward to encounter the fourth sides 35, 55 of the panel assembly 11 enabling the recess 24 of the holding cap to matchably receive the flat portion of the fourth sides 35, 55. Thereafter, the releasibly inserting plug 22A is inserted into another opening of the holding cap 21. The card is releasably displayed and protected within the display holder 10A. The card can be readily removed from the display holder 10A at wish or if needed for displaying a second card simply by removing the releasibly inserting plug 22A and the holding cap 21 from the panel assembly 11.

In a preferred embodiment, during operations of a latchable card placement for securely holding a card, a collectible card 41 is placed into the recess 31 of the rear panel 16 when the two panels 12, 16 of the panel assembly 11 are separated at an angle ready for receiving a card. In one embodiment, at least one panel is transparent or partially transparent. The front panel 12 is then lowered toward the rear panel 16 so as to enclose the card 41 inside the recess area as desired. The interior side 24 of the holding cap 21 is then forwarded to encounter the fourth sides 35, 55 of the panel assembly 11 enabling the recess 24 of the holding cap 21 to matchably receive the flat portion of the fourth sides 35, 55, wherein the panel assembly has at least one latchable extending member 56A. Thereafter, the latchable plug 22B is inserted into another opening of the holding cap 21 enabling the matching latchable mechanism 56B to be coupled to the member 56A. The card is permanently displayed and protected within the display holder 10B unless the display holder is broken or damaged. This type of permanently securing a valuable collectible card inside a display holder with an easily ready operation is obviously important. There won't be any dispute as to the quality or authenticity of the card once the card is placed in this secured display holder 10B of the present invention.

Figure 11:
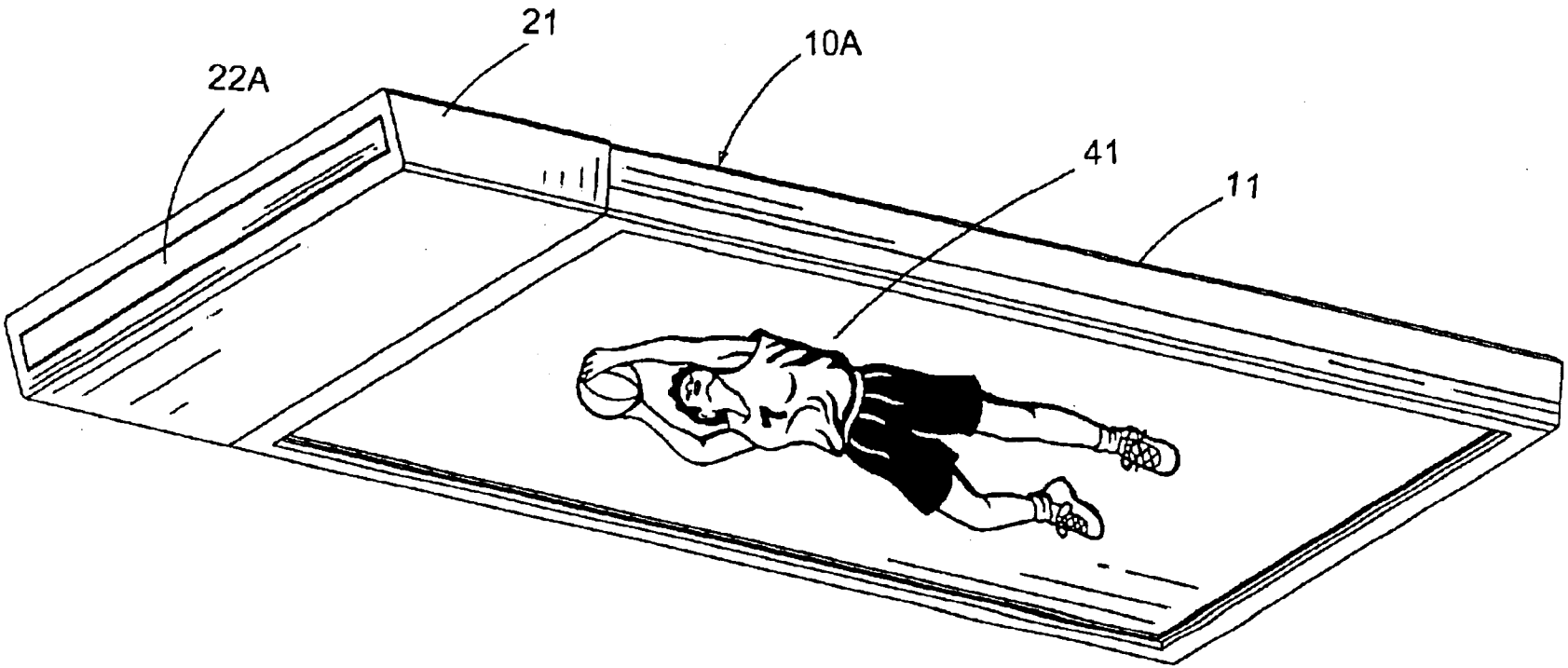
FIG. 11 is a perspective view of the display holder having a releasibly inserting collectible card in place.
Figure 12:
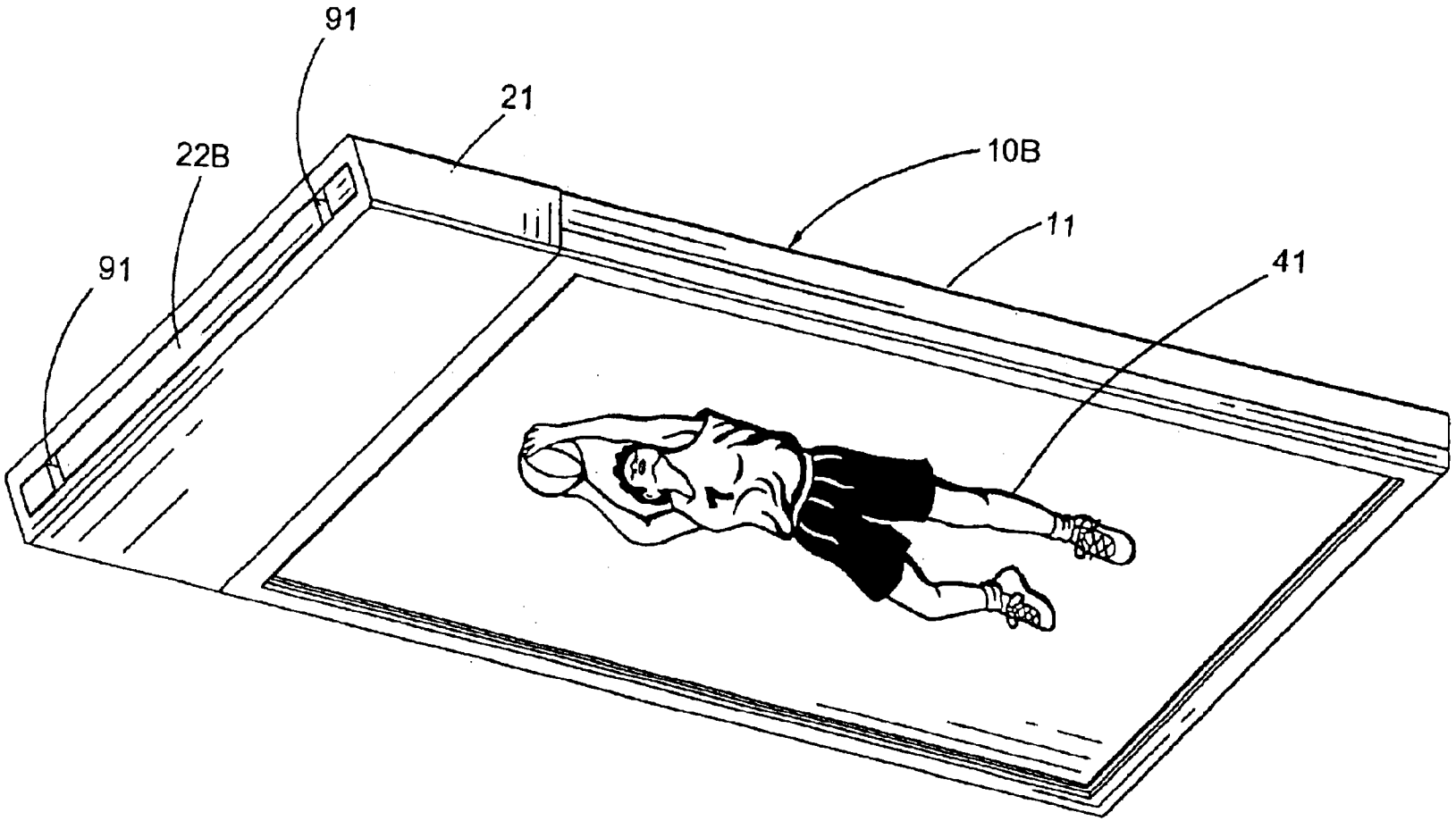
FIG. 12 is a second perspective view of the display holder having a securely latched collectible card in place.

FIG. 11 shows a perspective view of the display holder 10A with a valuable collectible card 41 in place, while FIG. 12 shows another perspective view of the display holder 10B with the valuable collectible card 41 in place and an identifiable marker 91. The interior surface 17 of the rear panel 16 and the interior surface 13 of the front panel 12 are generally flat and smooth configured to match both surfaces intimately after a card is placed within the recess portion to prevent the card from inadvertently falling out of the holder 10A or 10B. The front and rear panels of the matching elongate rectangular perimeter is configured and adapted to be cohesively matched to enclose a sports card.

The holder 10A, 10B possesses sufficient stiffness so as to be capable of protecting the valuable card placed within. The panel assembly 11 and the holding cap means 20B having a holding cap 21 and a latchable plug 22B are suitably arranged and configured so as to permit the card to be easily placed and secured in a simple 1-2-3 steps without nailing, gluing, stapling, threading or other messy fastening steps.

Figure 13:
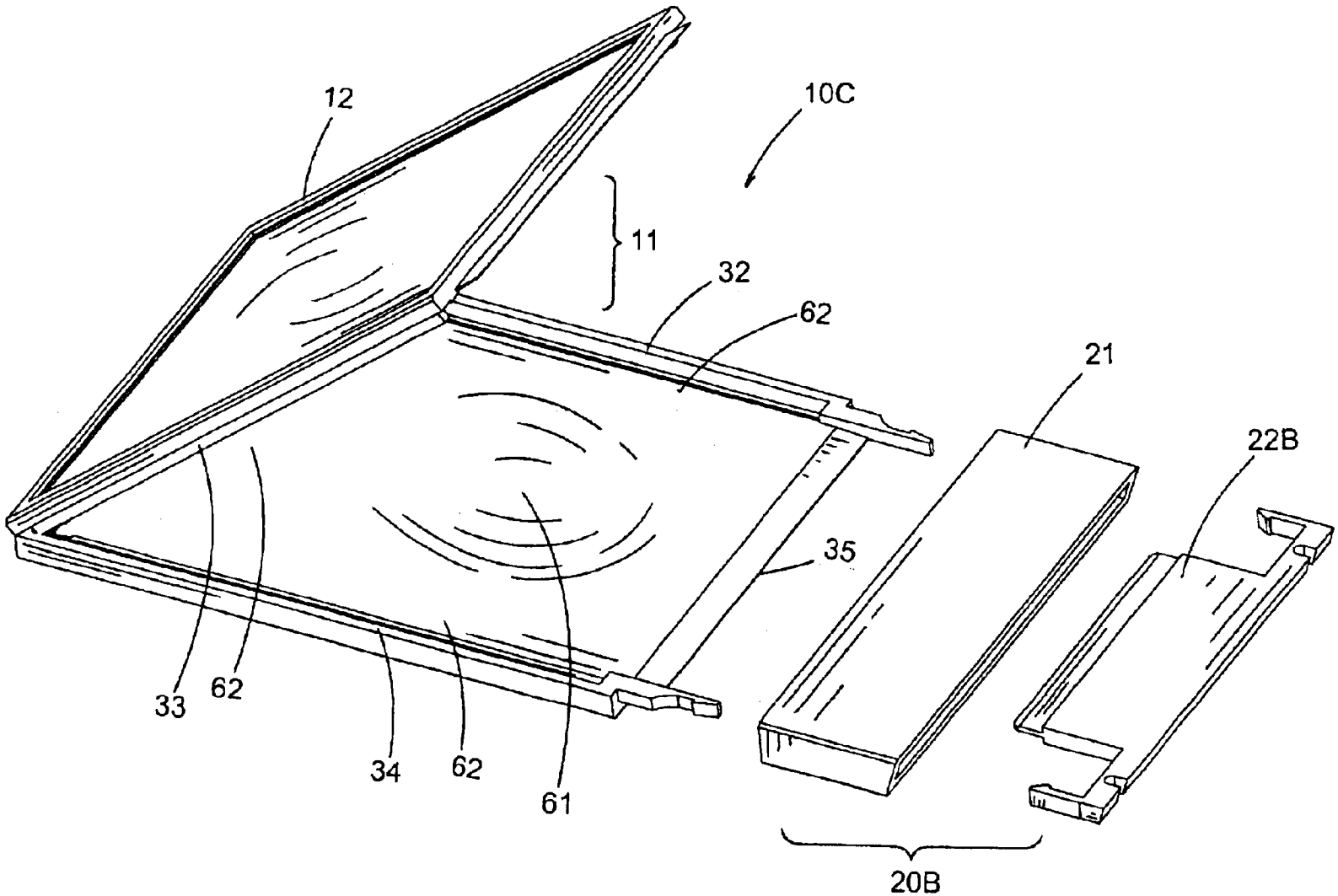
FIG. 13 is a perspective view of a second display holder comprising two coupled panels with matching contoured surfaces and a holding cap means according to the principles of the present invention.

FIG. 13 shows a perspective view of another embodiment of a display holder 10C comprising two coupled panels 12, 16 with matching contoured surfaces and a holding cap means 20B according to the principles of the present invention. In one embodiment, at least one panel is transparent or partially transparent. In some aspect of the present invention, it is provided that the rear panel 16 has a slightly concaved surface 61 at about the middle section of the recess 31 while the periphery region 62 adjacent to the sides 32, 33, 34, 35 of the recess 31 is relatively flat. The front panel 12 has a slightly convexed surface 66 at bout the middle section of the recess or projection surface that suitably matches the recess 31 of the rear panel 16. In another aspect, the real panel has a slightly convexed surface while the front panel has a slightly concaved matching surface. The surface contoured structure, functioning like a magnifier, makes the inserted card appears larger for displaying and enhanced viewing.

It is to be understood that the display holder could be constructed with a larger or smaller dimension as long as a card is reasonably placed within the recess portion of the holder without departing from the spirit and scope of the invention. The overall shape and dimension of the display holder can be configured as wish without departing from the spirit and scope of the invention. The card may bc intimately held by the two panels inside the recess or the card may have room inside the recess portion for slight movement.

It will be appreciated that it is one object of the present invention to provide a display holder comprising two panels connected together along a common hinge line and a holding cap for securing the two panels after a collectible card is inserted within. It is a further object of the present invention to provide a display holder comprising two panels connected together along a common hinge line and a holding cap for latchably securing the two panels after a collectible card is inserted within.

From the foregoing description, it should now be appreciated that a display holder for holding and displaying a valuable collectible card in a convenient and easily ready operation step has been disclosed. While the invention has been described with reference to a specific embodiment, the description is illustrative of the invention and is not to be construed as limiting the invention. Various modifications and applications may occur to those who are skilled in the art, without departing from the true spirit and scope of the invention, as described by the appended claims.

What is claimed is:

1. A display holder for suitably holding a collectible card comprising:

a panel assembly comprising a transparent front panel and a rear panel coupled together along a common hinge line, wherein the rear panel has a first edge opposing said common hinge line and the front panel has a second edge opposing said common hinge line;

said rear panel having a recessed portion having a card dimension and a first depth for receiving the card to bc held, wherein the first depth is equal to or slightly larger than a thickness of the card; and a holding cap means having a holding cap with a cap recess and an inserting plug for matchably receiving said first and second edges and holding said first and second edges together inside said cap recess.

2. The display holder or claim 1, wherein the holding cap means is color coded for card-type identification.

3. The display holder of claim 1, wherein the holding cap means comprises an embedded microchip having pre-loaded data for card inventory and identification.

4. The display holder of claim 1, wherein said front panel further comprises a recessed portion having a card dimension and a second depth for partially receiving the card to be held, wherein a sum of the first depth and the second depth is equal to or slightly larger than the thickness of the card.

5. The display holder of claim 1, wherein said holder is made of a material selected from a group consisting of polyvinyl chloride, polyester, polycarbonate, polystyrene, polyether, acrylic, poly(methyl methacrylate), and mixtures thereof.

6. A display holder suitable for securely holding a collectible card comprising:

a panel assembly comprising a transparent front panel and a rear panel coupled together along a common hinge line, wherein the rear panel has a first edge opposing said common hinge line and the front panel has a second edge opposing said common hinge line;

said rear panel having a recessed portion having a card dimension and a first depth for receiving the card to be held, wherein the first depth is equal to or slightly larger than a thickness of the card; and a holding cap means having a holding cap with a cap recess and a latchable plug having a latching mechanism mounted therein for matchably receiving said first and second edges and latchably holding said first and second edges together inside said cap recess, wherein an extending member connected to the first edge or the second edge, said member having a plurality of directional edges and notches allowing latching functions in response to the latching mechanism mounted within the plug of the holding cap means.

7. The display holder of claim 6, wherein the holding cap means is color coded for card-type identification.

8. The display holder of claim 6, wherein the holding cap means comprises an embedded microchip having pre-loaded data for card inventory and identification.

9. The display holder of claim 6, wherein said front panel further comprises a recessed portion having a card dimension and a second depth for partially receiving the card to be held, wherein a sum of the first depth and the second depth is equal to or slightly larger than the thickness of the card.

10. The display holder of claim 6, wherein said holder is made of a material selected from a group consisting of polyvinyl chloride, polyester, polycarbonate, polystyrene, polyether, acrylic poly(methyl methacrylate), and mixtures thereof.

11. A display holder suitable for holding a collectible card comprising:

a panel assembly comprising a transparent front panel and a transparent rear panel coupled together along a common edge line, wherein the rear panel has a first edge opposing said common edge line and the front panel has a second edge opposing said common edge line;

said rear panel having a recessed portion having a bottom surface, a card dimension and a first depth for receiving the card to be held, wherein the bottom surface comprises a slightly concave configuration; and a holding cap means having a holding cap with a cap recess and a plug for matchably receiving said first and second edges and holding said first and second edges together inside said cap recess.

12. The display holder of claim 11, wherein the holding cap means is color coded for card-type identification.

13. The display holder of claim 11, wherein the holding cap means comprises an embedded microchip having pre-loaded data for card inventory and identification.

14. The display holder of claim 11, wherein said front panel further comprises a recessed portion having a second bottom surface, a card dimension and a second depth for partially receiving the card to be held, wherein the second bottom surface comprises a convex configuration.

15. The display holder of claim 11, wherein said holder is made of a material selected from a group consisting of polyvinyl chloride, polyester, polycarbonate, polystyrene, polyether, acrylic, poly(methyl methacrylate), and mixtures thereof.

16. The display holder of claim 11, wherein the holding cap further comprises a latching member mounted on the plug, and wherein an extending member is connected to the first edge or the second edge, said member having a plurality of directional edges and notches allowing latching functions in response to the latching mechanism for securely holding said first and second edges together inside said cap recess.

17. The display holder of claim 11 further comprising a hinge means for coupling said front and rear panels together along the common edge line.

18. The display holder of claim 11 further comprising a latchable means for coupling said front and rear panels together along the common edge line.

* * * * *